United States Patent [19]

Horie et al.

[11] 4,334,001

[45] Jun. 8, 1982

[54] AZACYANINE SPECTRA SENSITIZED ORGANIC PHOTOCONDUCTIVE COMPOSITIONS AND ELEMENTS

[75] Inventors: Seiji Horie; Hideo Sato, both of Asaka, Japan

[73] Assignee: Fuji Photo Film Co., Ltd., Kanagawa, Japan

[21] Appl. No.: 214,157

[22] Filed: Dec. 8, 1980

[30] Foreign Application Priority Data

Dec. 7, 1979 [JP] Japan ..... 54-158148

[51] Int. Cl.[3] ..... G03G 5/09

[52] U.S. Cl. ..... 430/83; 430/81; 430/82; 430/581; 430/582

[58] Field of Search ..... 430/83, 81, 82, 581, 430/582

[56] References Cited

U.S. PATENT DOCUMENTS 3,647,433 3/1972 Contois ..... 430/83 X

*Primary Examiner*—John D. Welsh

*Attorney, Agent, or Firm*—Sughrue, Mion, Zinn, Macpeak and Seas

[57] ABSTRACT

A photoconductive composition comprising a photoconductive substance and at least one spectral sensitizer selected from azacyanines represented by formula (I), (II), (III), (IV) or (V)

(I)

(II)

(III)

(IV)

(V)

and a photosensitive member containing such a spectral sensitizer.

9 Claims, 4 Drawing Figures

AZACYANINE SPECTRA SENSITIZED ORGANIC PHOTOCONDUCTIVE COMPOSITIONS AND ELEMENTS

BACKGROUND OF THE INVENTION

This invention relates to photoconductive compositions and members containing photoconductive substances and spectral sensitizers. More particularly, this invention relates to photoconductive compositions and materials containing photoconductive substances and azacyanine spectral sensitizers.

Hitherto, many organic compounds have been known as photoconductive substances for electrophotographic sensitive materials. Among them, some compounds have been confirmed to have relatively high sensitivity. Under existing circumstances, however, there are very few cases wherein an organic photoconductive substance has been practically used for the electrophotographic sensitive materials. Organic photoconductive substances have many excellent properties as compared with inorganic photoconductive substances, and have possibilities of various utilizations in the field of electrophotography. For example, production of transparent photosensitive films, flexible sensitive films and light-weight sensitive films capable of easy handling becomes possible by use of organic photoconductive substances. Further, they have characteristics which cannot be expected in inorganic photoconductive substances, for example, a film-forming property for production of sensitive materials, surface smoothness, and selectivity of charge polarity when applied to an electrophotographic copying process, etc. However, organic photoconductive substances have not sufficiently contributed to the field of electrophotography up to now in spite of having such various excellent characteristics in many viewpoints, because they generally have low sensitivity to light.

Generally, in case that the sensitivity of the photoconductive substance itself is low and is in a range of short wavelength spectra, certain substances may be added in order to increase the sensitivity and to transfer the sensitivity to a range of longer wavelength spectra.

As sensitizers for improving the sensitivity, though many organic substances have been known, they each have disadvantages together with advantages and there is no completely satisfactory sensitizer in the viewpoint of improving the sensitizing effect. Therefore, it is a subject desired for a long time by persons skilled in the art to develop more effective spectral sensitizers for organic photoconductive substances.

For example, thiacarbocyanines containing an electron attractive group, such as halogen, nitro, etc., as described in Japanese Pat. Publication No. 2 632 144 have already been known as a spectral sensitizer for the organic light-conductive substance. Although this spectral sensitizer has the advantage that it improves sensitivity characteristics because it contains an electron attractive nitro group, etc., it suffers the disadvantages that it is inferior in solubility, and, when a coating film is formed using the sensitizer, causes deposition of crystals, etc., making it difficult to obtain a uniform coating film, and that the uneven coating film markedly reduces the light sensitivity.

SUMMARY OF THE INVENTION

An object of this invention is to provide a photoconductive composition and a member containing a photoconductive substance, and a spectral sensitizer which produces a high spectral sensitizing effect to the photoconductive substance.

Another object of this invention is to provide a photoconductive composition and a member containing a photoconductive substance and a spectral sensitizer which is excellent in light durability, in that it is not subject to discoloration and does not deteriorate in spectral sensitizing properties over a long period of time, which is easily available from an economic standpoint, and which produces a high spectral sensitizing effect.

Still another object of this invention is to provide a photoconductive composition and a member containing a photoconductive substance and a spectral sensitizer for a photoconductive substance which is satisfactory in solubility and increased in sensitivity characteristics, i.e., is excellent in terms of both solubility and sensitivity characteristics.

A further object of this invention is to provide a photoconductive composition and a member containing a photoconductive substance and a spectral sensitizer for a photoconductive substance which can sensitize the substance in blue, green, and red regions of the light.

As a result of extensive investigations to settle the above-described problems, it has now been found that the problems can be solved by employing particular azacyanine spectral sensitizers in photoconductive compositions and members.

Thus, spectral sensitizers of this invention are azacyanines represented by the following formulae:

(I)

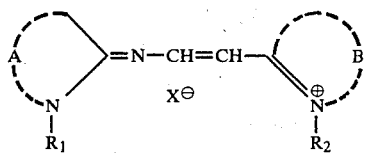

(II)

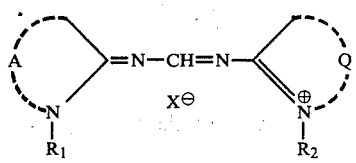

(III)

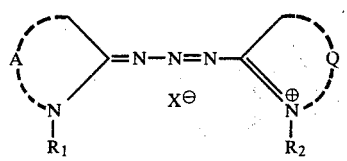

(IV)

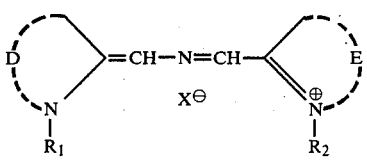

(V)

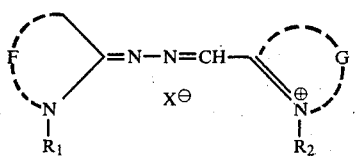

In the above formulae, A, together with the group
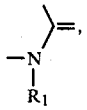
is a group represented by formula (1), (2), (3) or (4).
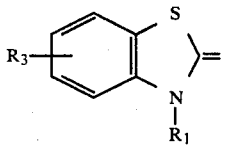
(1)
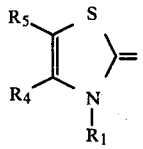
(2)
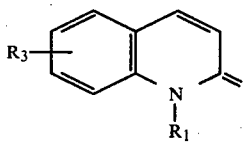
(3)
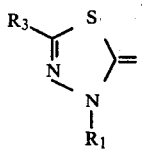
(4)
B, together with the group
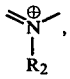
is a group represented by formula (5), (6), (7), (8), (9), or (10)
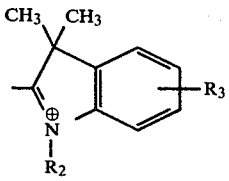
(5)
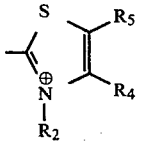
(6)
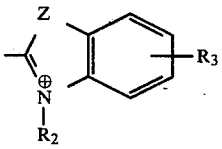
(7)
-continued
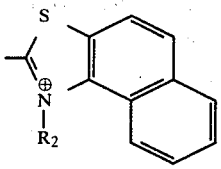
(8)
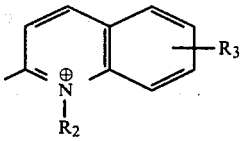
(9)
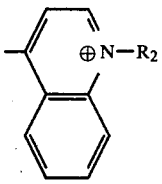
(10)
wherein Z represents —O—, —Se— or —S—.
Q, together with the group
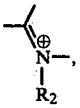
is a group represented by formula (11), (12), (13) or (14).
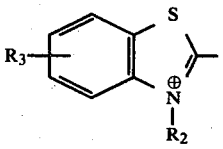
(11)
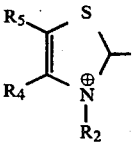
(12)
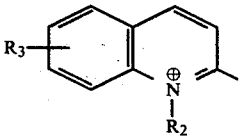
(13)
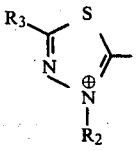
(14)
D, together with the group

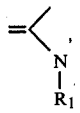
is a group represented by formula (15) or (16).
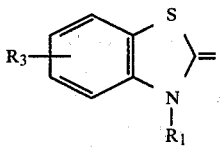
(15)
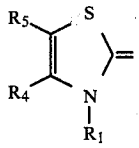
(11)
E, together with the group
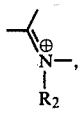
is a group represented by formula (17) or (18).
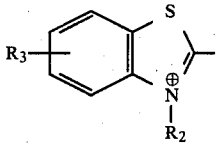
(17)
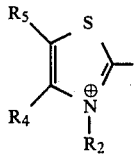
(18)
F, together with the group
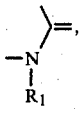
is a group represented by formula (19), (20), (21), (22) or (23).
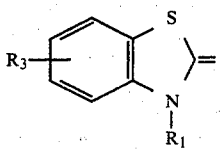
(19)
-continued
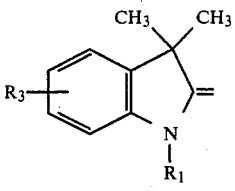
(20)
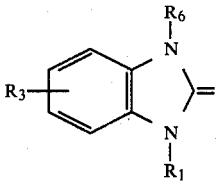
(21)
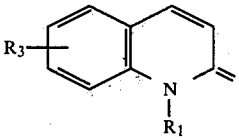
(22)
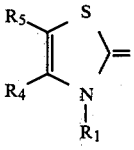
(23)
G, together with the group
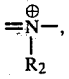
is a group represented by formula (24), (25), (26) or (27).
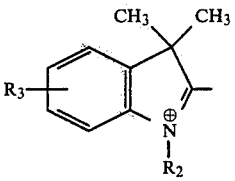
(24)
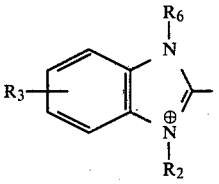
(25)
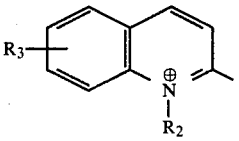
(26)

-continued (27)

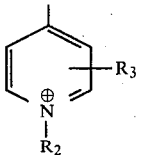

$R_1$, $R_2$, and $R_6$ are each an alkyl group, and $R_3$, $R_4$, and $R_5$ are each hydrogen, an alkyl group, an alkoxy group, or a substituted alkyl group.

DETAILED DESCRIPTION OF THE INVENTION

Figure 1:
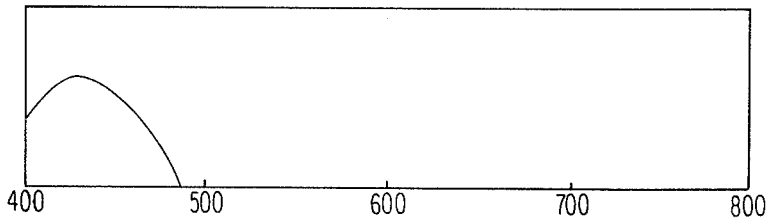
FIGS. 1, 2, 3 and 4 are spectral sensitivity spectra of photoconductive light-sensitive members comprising poly-N-vinylcarbazole which contain azacyanine dyes (x), (xiii), (xv) and (vii) of this invention, respectively.

Preferably, the alkyl group represented by $R_1$, $R_2$, or $R_6$ is an alkyl group containing from 1 to 12 carbon atoms, more preferably an alkyl group containing from 1 to 4 carbon atoms, e.g., a methyl group, an ethyl group, a propyl group or a butyl group. The alkyl group represented by $R_3$, $R_4$, or $R_5$ is the same as that represented by $R_1$, $R_2$ or $R_6$, the alkoxy group represented by $R_3$, $R_4$, or $R_5$ is an alkoxy group containing from 1 to 12 carbon atoms, more preferably from 1 to 4 carbon atoms, such as an ethoxy group, a propoxy group, etc., and the substituted alkyl group represented by $R_3$, $R_4$, or $R_5$ contains from 1 to 18, more preferably from 1 to 12, and most preferably from 1 to 4 carbon atoms, e.g., (1) alkoxyalkyl such as ethoxypropyl, methoxybutyl, propoxymethyl, etc., (2) aryloxyalkyl such as phenoxyethyl, naphthoxymethyl, phenoxypentyl, etc., (3) hydroxyalkyl such as hydroxyethyl, hydroxypropyl, hydroxyoctyl, hydroxymethyl, etc., (4) aralkyl such as benzyl, phenethyl ω,ω-diphenylalkyl, etc., (5) cyanoalkyl such as cyanopropyl, cyanobutyl, cyanoethyl, etc., or (6) haloalkyl such as chloromethyl, bromopentyl, chlorooctyl, etc.

Of the compounds represented by formula (V), those in which at least one of the groups constituted by F and G is the indolenine nucleus represented by (20) or (24) are most preferred in terms of the solubility.

Preferred examples of azacyanine dyes of this invention are shown in Table 1.

TABLE 1

| Dyes | |
|---|---|
| (i) | 3,3'-Diethyl-8-azathiacarbocyanine perchlorate 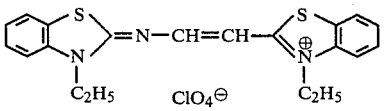 |
| (ii) | 3,3'-Diethyl-oxa-8-azathiacarbocyanine perchlorate 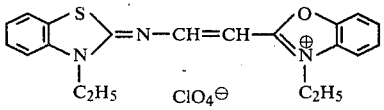 |
| (iii) | 3-Ethyl-1',3',3'-trimethylindo-8-azathiacarbocyanine perchlorate |

TABLE 1-continued

| Dyes | |
|---|---|
| | 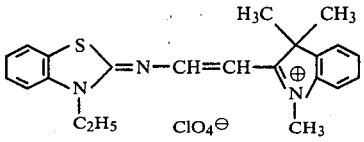 |
| (iv) | 1',3-Diethyl-8-azathia-2'-carbocyanine perchlorate |
| | 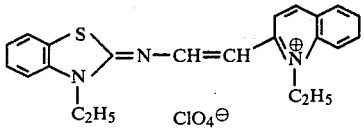 |
| (v) | 1',3-Diethyl-8-azathia-4'-carbocyanine perchlorate |
| | 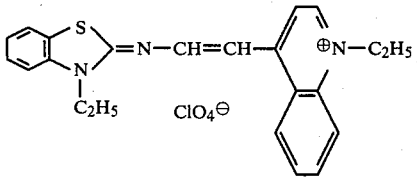 |
| (vi) | 3-Methyl-3'-ethyl-8,9-diazathiacarbocyanine perchlorate |
| | 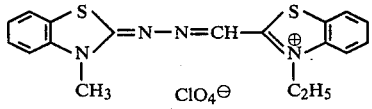 |
| (vii) | 3-Methyl-1',3',3'-trimethylindo-8,9-diazathia-carbocyanine perchlorate |
| | 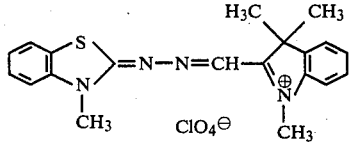 |
| (viii) | 3-Methyl-1'-ethyl-8,9-diazathia-2'-carbocyanine perchlorate |
| | 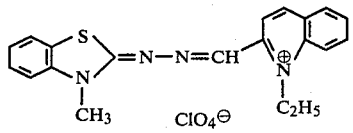 |
| (ix) | 3-Methyl-1'-ethyl-4'-pyrido-8,9-diazathiacarbocyanine p-toluenesulfonate |
| | 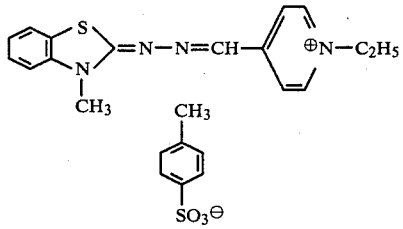 |
| (x) | 3,3'-Diethyl-8,10-diazathiacarbocyanine perchlorate |
| | 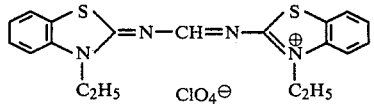 |
| (xi) | 3,3'-Diethyl-9-azathiacarbocyanine iodide |
| | 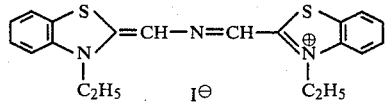 |
| (xii) | (3-Ethyl-2-thiazole) (3'-ethyl-2'-benzothiazole)-6-azatrimethinecyanine perchlorate |

TABLE 1-continued

Dyes

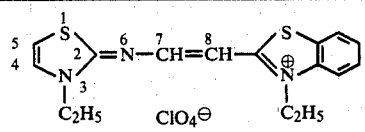

(xiii) (3-Ethyl-2-thiazole) (3'-ethyl-2'-benzoxazole)-6-azatrimethinecyanine perchlorate

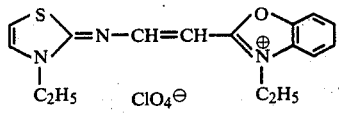

(xiv) (3-Ethyl-2-thiazole) (1',3',3'-trimethyl-2'-indole)-6-azatrimethinecyanine perchlorate

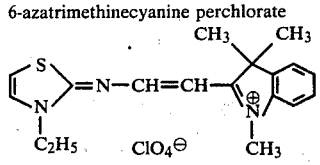

(xv) (3-Ethyl-2-thiazole) (1'-ethyl-2'-quinoline)-6-azatrimethinecyanine perchlorate

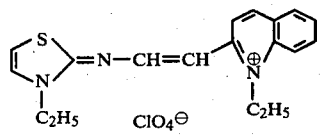

(xvi) (3-Ethyl-2-thiazole) (1'-ethyl-4'-quinoline)-6-azatrimethinecyanine perchlorate

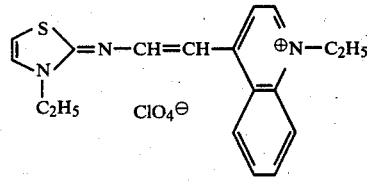

(xvii) (3-Ethyl-2-thiazole) (3'-ethyl-2'-thiazole)-6,8-diazatrimethinecyanine perchlorate

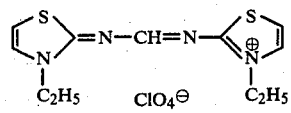

(xviii) (3-Methyl-6-methoxy-2-benzothiazole) (3'-methyl-2'-benzothiazole)-triazamethinecyanine perchlorate

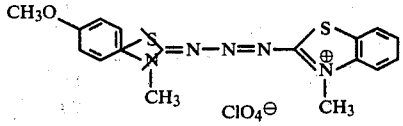

(xix) (3-Methyl-6-methoxy-2-benzothiazole) (1',3'-dimethyl-2'-benzimidazole)-triazamethinecyanine perchlorate

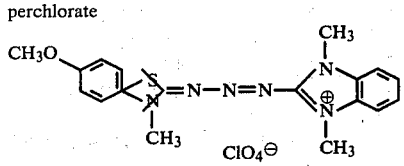

(xx) (3-Methyl-6-methoxy-2-benzothiazole) (1'-methyl-2'-quinoline)-triazamethinecyanine perchlorate

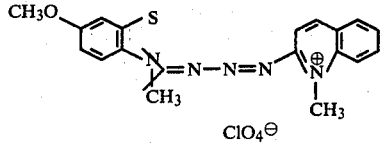

(xxi) 3,3'-Diethyl-4,4'-dimethyl-2,2'-thiazole-9-azatrimethinecyanine iodide

TABLE 1-continued

Dyes

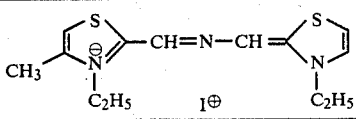

Spectral sensitizers of this invention, i.e., azacyanine dye compounds, can be synthesized by the methods described in E. B. Knott & L. A. Williams, *Journal of Chemical Society,* 1586 (1951), F. M. Hamer & N. I. Fisher, *Journal of Chemical Society,* 907 (1937), A. I. Kiprianov, *Zhurnal Obshchei Khim.,* 33, 479 (1963) and British Pat. No. 447,038.

For example, they can be prepared as follows:

The azacyanine dye represented by formula (I) can be obtained by reacting a $\beta$-acetoanilide vinyl derivative and a 2-amino heterocyclic quaternary salt.

The azacyanine dye represented by formula (II) can be obtained by reacting a 2-amino heterocyclic ring quaternary salt and an orthoformic acid ester in pyridine.

The azacyanine dye represented by formula (III) can be obtained by condensation of a 2-amino heterocyclic ring quaternary salt and a 3-methyl-2-nitrosoimino heterocyclic ring.

The azacyanine dye represented by formula (IV) can be obtained by reacting a quaternary salt of a 2-aminomethyl heterocyclic ring and heterocyclic ring-2-aldehyde and quaternizing the resulting compound.

The azacyanine dye represented by formula (V) can be obtained by reacting a p-diethylaminoanil derivative of a 2-aldehyde heterocyclic ring quaternary salt and 3-methyl-2-benzothiazolinonehydrazone in cooled and diluted hydrochloric acid.

The azacyanine dyes of this invention are highly effective in spectral sensitization of various inorganic and organic photoconductive substances, particularly organic photoconductive substances.

The spectral sensitizer of this invention, when used in a photoconductive composition, exhibits excellent characteristics as a sensitizer because the spectral sensitizer has a property showing a large decay of the initial electric potential by light as compared with those of conventional spectral sensitizing dyes. This is believed to be due to the electron attractive effect of the nitrogen atom in the sensitizer of this invention. In addition, the spectral sensitizer of this invention has advantages in that its light durability is high, i.e., even when exposed to sunlight for a long period of time, it suffers no discoloration and no deterioration in the sensitization effect, and in that it is easily available from an economic viewpoint.

The spectral sensitizer of this invention is excellent in that it increases the sensitivity of the photoconductive substance without causing the reduction of the solubility which occurs with conventional spectral sensitizers; that is, it is excellent in both sensitivity characteristics and solubility.

The azacyanine dyes used in this invention can be used in combination with various photoconductive substances to prepare the corresponding photoconductive compositions. That is, the sensitizer of this invention contributes to the high sensitization of the photoconductive substance, particularly the organic photoconductive substance.

Many compounds are known as organic photoconductive substances. Among them, the following compounds show an excellent sensitization effect by the sensitizers of the present invention. (A) Vinylcarbazoles, including, for example, vinylcarbazole, poly-9-vinylcarbazole, 9-vinylcarbazole copolymers, 3-nitro-9-vinylcarbazole copolymers, nitrated poly-9-vinylcarbazole, poly-9-vinyl-3-aminocarbazole, 3-N-methylamino-9-vinylcarbazole copolymers, halogenated vinylcarbazoles, 3,6-dibromo-9-vinylcarbazole copolymers, brominated poly-9-vinylcarbazole, 3-iodo-9-vinylcarbazole copolymers, poly-3,6-diiodo-9-vinylcarbazole, poly-3-benzylideneamino-9-vinylcarbazole, poly-9-propenylcarbazole, graft copolymer of 9-vinylcarbazole and ethyl acrylate (molar ratio: 90:10), vinylanthracene-9-vinylcarbazole copolymer, and homopolymers and copolymers of 2-(or 3-)vinyl-9-alkylcarbazole (where the alkyl group is a primary alkyl group such as methyl, ethyl or propyl, etc.).

(B) Aromatic amino derivatives, including, for example, aminopolyphenyl allylideneazines, N,N'-dialkyl-N,N'-dibenzyl phenylenediamine, N,N,N',N'-tetrabenzyl-p-phenylenediamine, N,N'-diphenyl-p-phenylenediamine, N,N'-dinaphthyl-p-phenylenediamine and 4,4'-bis-dimethylaminobenzophenone, etc.

(C) Polyarylalkane derivatives, including leuco bases of diaryl- or triarylmethane dye salts, 1,1,1-triarylalkanes in which the alkane portion has at least two carbon atoms, and tetraarylmethanes. The latter two derivatives are non-leuco bases wherein at least one of aryl groups bonding to the alkane or methane portion is substituted by an amino group. Examples thereof include 4',4''-bis(diethylamino)-2',2''-dimethyltriphenylmethane, 4,4''-bis(dimethylamino)-2',2''-dimethyl-4-methoxytriphenylmethane, 4',4''-bis(benzylethylamino)-2',2''-dimethyltriphenylmethane, 4',4''-bis(-diethylamino)-2',2''-diethoxytriphenylmethane, 2',2''-dimethyl-4,4',4''-tris(dimethylamino)triphenylmethane and 4,4'-bis(dimethylamino)-1,1,1-triphenylethane, etc.

(D) Compounds having heterocyclic groups including, for example, oxadiazole, ethylcarbazole, N-n-hexylcarbazole, 5-aminothiazole, 4,1,2-triazole, imidazolone, oxazole, imidazole, pyrazoline, imidazolidine, polyphenylene thiazole, 6,6-methoxyphenazine, $\alpha,\omega$-bis(N-carbazolyl)alkane derivatives and pyrazolinopyrazoline derivatives, etc.

(E) Compounds having condensed rings, including, for example, benzothiazole, benzimidazole, benzoxazoles such as 2-(4'-diethylaminophenyl)benzoxazole and 2-(4'-dimethylaminophenyl)benzoxazole, etc., aminoacridine, quinoxaline, diphenylene hydrazones, pyrrocoline derivatives and 9,10-dihydroanthracene derivatives, etc.

(F) Compounds having double bonds, including, for example, acyl hydrazones, ethylene derivatives, 1,1,6,6-tetraphenylhexatriene and 1,1,5-triphenyl-pent-1-en-4-yn-3-ol, etc.

(G) Condensation products, including, for example, condensation products of aldehyde and aromatic amine, reaction products of secondary aromatic amine and aromatic halogenide, polypyrromethanoimide and poly-p-phenylene-1,3,4-oxadiazole, etc.

(H) Vinyl polymers, including, for example, $\alpha$-alkylacrylic acid amide polymers, polyvinyl-acridine, poly[1,5-diphenyl-3-(4-vinylphenyl)-2-pyrazoline], poly(1,5-diphenylpyrazoline), polyacenaphthylene, substituted polyacenaphthylenes, polyvinylanthracene and poly-2-vinyldibenzothiophene, etc.

(I) Examples of useful organic photoconductive oligomers include the following.

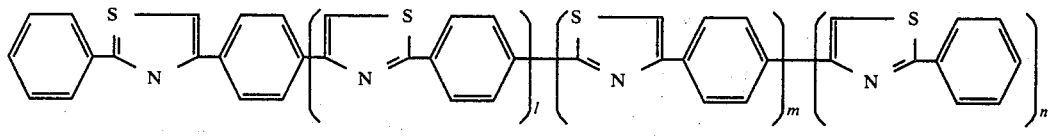

(wherein l, m and n are 0 or 1, and have a relation of $l \geqq m \geqq n$) More particularly, examples thereof include p-bis(2-phenyl-4-thiazolyl)benzene as a compound having five rings, 2,4-bis[4-(2-phenyl-4-thiazolyl)phenyl]-thiazole as a compound having seven rings and 1,4-bis-4-[4-(2-phenyl-4-thiazolyl)phenyl]thiazolylbenzene as a compound having nine rings, etc.

Although the amount of the spectral sensitizer of this invention being used varies depending upon the type of the sensitizer and the type of the organic photoconductive substance, it is generally used in an amount of 0.005 to 10 parts by weight per about 1 to 80 parts by weight of the organic photoconductive substance with good results. Preferably, the spectral sensitizer is used in an amount of from about 0.01 to 1 part by weight per about 1 to 80 parts by weight of the organic photoconductive substance.

In using the spectral sensitizer of this invention, it is generally preferred to dissolve in a solvent capable of dissolving both the spectral sensitizer and the organic photoconductive substance, such as methylene chloride, ethylene chloride, chloroform, tetrahydrofuran, N,N-dimethylformamide, cyclopentane, benzene, toluene, etc.

Insulative film-forming binders or photoconductive film-forming binders as described above, such as polyvinylcarbazole, etc., can be used in the organic photoconductive composition of this invention. The amount of the binder used is 0.2 to 100 parts by weight, preferably 0.3 to 3 parts by weight, per 1 part by weight of the organic photoconductive member. Preferred insulative film-forming binders include polystyrene, poly(methylstyrene), a styrene-butadiene copolymer, polyvinyl chloride, polyvinylidene chloride, polyvinyl acetate, a vinyl acetate-vinyl chloride copolymer, polyvinyl acetal, polyacrylate, polymethacrylate, polyester [e.g., poly(ethylenealkaryloxy-alkylene-terephthalate)], a phenol-formaldehyde resin, polyamide, polycarbonate, etc.

To the photoconductive composition of this invention there can be added, if desired, a plasticizer and other additives. These additives are preferably dissolved or dispersed in a solvent.

Various methods can be used to prepare a photosensitive member using the photoconductive composition of this invention, including: a method in which the photoconductive composition is dissolved or dispersed in a solvent, coated on an electrically conductive support and dried; a method in which each component as described above is melt-coated on an electrically conductive support; and a method in which a light-sensitive thin film is previously formed from a solution of the photoconductive composition. Alternatively, a melt-extrusion film of the photoconductive composition may be used as a self-supporting film. Furthermore, grains produced from a solution of the photoconductive composition of this invention by the use of a mini-spray equipment by which a solution is sprayed through a nozzle to form grains are dispersed in an insulative liquid containing saturated hydrocarbon, such as decane, dodecane, octane, paraffin, isooctane, etc., to prepare a dispersion, and the dispersion so obtained is used in an electrophoresis method according to a method as described, for example, in Japanese Patent Publication No. 21781/68 and U.S. Pat. No. 3,384,448.

Electrically conductive supports which can be used include a conductivity-provided paper, an aluminum-paper laminate, a metal foil, e.g., an aluminum foil, a zinc foil, etc., a metal plate made of aluminum, copper, zinc, brass or a zinc-plated plate, and a support prepared by vapor-depositing a metal, e.g., chromium, silver, nickel, or aluminum, on paper or other known photographic film base materials, e.g., cellulose acetate, polystyrene, or the like. Preferred among these supports are those prepared by vapor-depositing metals such as chromium, silver, nickel, aluminum and indium oxide on paper, a cellulose acetate film, and a polyethylene terephthalate film.

The thickness of the photoconductive composition being coated on the support can be varied within wide ranges. The thickness of from about 1 to 200 microns, and preferably from about 2 to 50 microns, provides useful results.

Figure 2:
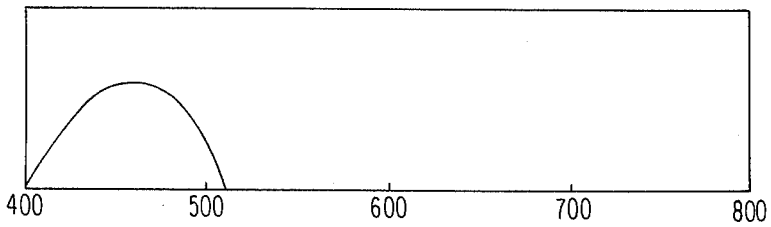
Figure 3:
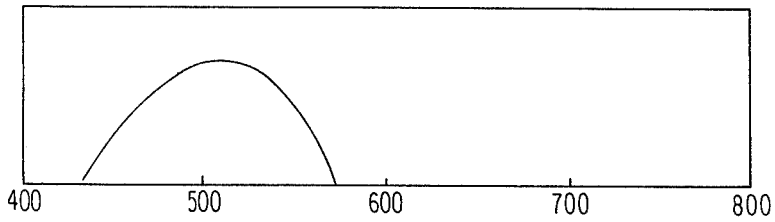
Figure 4:
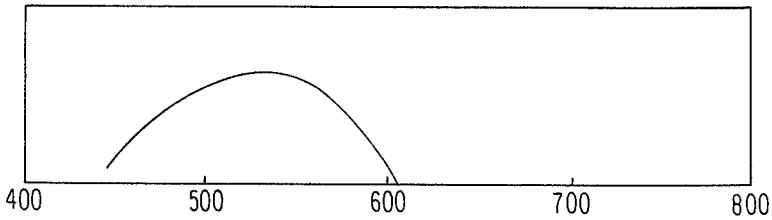

FIGS. 1, 2, 3, and 4 are spectral sensitivity spectra of photoconductive light-sensitive members using as a spectral sensitizer spectral sensitizers (x), (xiii), (xv) and (vii) and poly-N-vinylcarbazole as a photoconductive substance, respectively.

Hereinafter, the synthesis examples in which azacyanine dyes of this invention are prepared, and examples in which the azacyanine dyes are used are given to illustrate this invention in greater detail.

SYNTHESIS EXAMPLE 1

Preparation of 3-Ethyl-1′,3′,3′-trimethylindo-8-azathiacarbocyanine perchlorate [Dye (iii)]

A mixture of 10 g of 1,2,3,3-tetramethylindolenium perchlorate, 25 g of diphenylformamidine and 35 ml of acetic anhydride was heated at 120° to 130° C. for 20 minutes. Precipitated orange-yellow solids were filtered, washed with water, and then washed with acetone. They were then recrystallized from 180 ml of acetonitrile to obtain 12 g of 1,3,3-trimethyl-2-acetoanilidovinylindolenium perchlorate (Compound A).

A mixture of 10 g of Compound A, 8.5 g of 2-amino-3-ethylbenzothiazolium tosylate and 3.5 ml of triethylamine was dissolved in 100 ml of ethanol and refluxed for 1 hour.

On cooling the mixture, solids precipitated, and these solids were recrystallized from 400 ml of methanol to obtain 7.5 g of red needle-like crystals of Dye (iii).

SYNTHESIS EXAMPLE 2

Preparation of 3,3′-diethyl-8,10-diazathiacarbocyanine perchlorate [Dye (x)]

A mixture of 20 g of 2-amino-3-ethylbenzothiazolium tosylate and 40 g of ethyl orthoformate was heated in 20 ml of pyridine at 110° C. to 120° C. for 20 minutes. At the time of cooling the mixture, a solution prepared by dissolving 20 g of sodium perchlorate in 100 ml of water was poured thereinto. Precipitated orange solids were fully washed with water and dried. Yield, 9.0 g of Dye (x).

SYNTHESIS EXAMPLE 3

Preparation of 3-methyl-3′-ethyl-8,9-diazathiacarbocyanine [Dye (vi)]

20 g of a p-diethylaminoanil derivative of benzothiazol-1-aldehyde was dissolved in 800 ml of diluted hydrochloric acid and cooled. A solution prepared by dissolving 10 g of 3-methyl-2-benzothiazolinonhydrazone hydrochloride in 300 ml of water was dropwise added thereto. The resulting mixture was heated on a water bath for 10 minutes, and thereafter, on pouring an aqueous solution prepared by dissolving 50 g of sodium perchlorate in water, red-brown crystals were obtained. These crystals were recrystallized from acetonitrile to obtain 6.0 g of red needle-like crystals of Dye (vi).

EXAMPLES 1 TO 14

6 g of poly-N-vinylcarbazole (trade mark, Luvican 170, produced by BASF Co.; intrinsic viscosity $[\eta]=1.18$, 25° C., in tetrahydrofuran) was dissolved in 120 ml of guaranteed ethylene chloride to prepare a mother liquor.

Light-sensitive solutions were prepared by adding 4 g of the mother liquor to an ethylene chloride solutions of the azacyanine dyes as illustrated in Table 2 so controlled that the amount of the azacyanine dye be $10^{-3}$ mol based upon the carbazole ring unit of poly-N-vinylcarbazole in the mother liquor. For comparison, a light-sensitive solution in which no azacyanine dye was used, and a light-sensitive solution in which a comparative dye as described in the footnote of Table 2 was used, were prepared and tested.

The light-sensitive solution was coated on an electrically conductive transparent support (100μ polyethylene terephthalate support with indium oxide vapor-deposited thereon and having a surface resistance of $10^3$ Ω) by means of a wire-round rod which is composed of a rod rounded by wire and used for coating and dried to obtain a light-sensitive member with an about 2μ thick light-sensitive layer.

The light-sensitive member was positively charged by application of corona discharge until the surface potential reached 300 V, and thereafter was exposed to light by the use of a 3,000° K. tunsten light source so that the intensity of illumination was 4.5 lux. The half-decay light-exposure amount $E_{50}$ (lux.sec) which represents an exposure amount required until the initial potential at the surface of the sensitive layer became one-half was measured and the results obtained are shown in Table 2.

TABLE 2

| | Dye No. | λ max* | $E_{50}$ (lux . sec) |
|---|---|---|---|
| Comparative Example 1 | none (control) | | 45,000 |

TABLE 2-continued

| | Dye No. | λ max* | $E_{50}$ (lux . sec) |
|---|---|---|---|
| Comparative Example 2 | comparative dye** | 561 | 97 |
| Example 1 | (i) | 476 | 34 |
| Example 2 | (ii) | 461 | 46 |
| Example 3 | (iii) | 491 | 22 |
| Example 4 | (iv) | 500 | 19 |
| Example 5 | (v) | 591 | 20 |
| Example 6 | (vi) | 510 | 34 |
| Example 7 | (vii) | 529 | 15 |
| Example 8 | (viii) | 521 | 19 |
| Example 9 | (ix) | 494 | 61 |
| Example 10 | (xii) | 473 | 55 |
| Example 11 | (xiii) | 474 | 78 |
| Example 12 | (xiv) | 476 | 30 |
| Example 13 | (xv) | 503 | 27 |
| Example 14 | (xvi) | 540 | 24 |

*Maximum absorption value (nm) in an ethylene chloride solution.
**Comparative dye

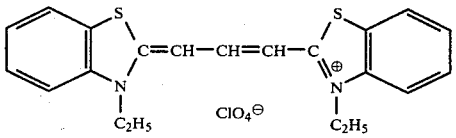

In the above Table 2, for example, $E_{50}$ value of 45,000 represents that it takes 10,000 seconds under 4.5 lux illumination to reduce the initial electric potential of 300 V at the surface of the sensitive layer to 150 V.

What is claimed is:

1. A photoconductive composition comprising an organic photoconductive substance and at least one spectral sensitizer selected from azacyanines represented by formula (I), (II), (III), (IV), or (V)

(I)

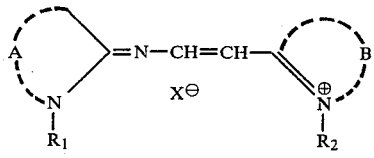

(II)

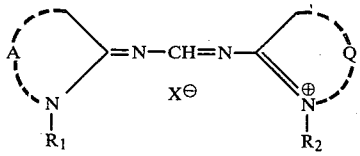

(III)

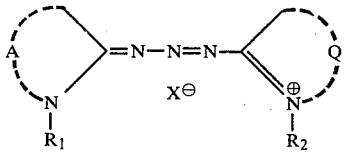

(IV)

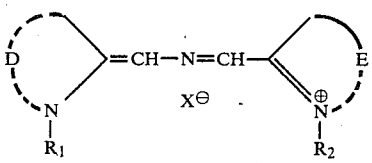

-continued (V)

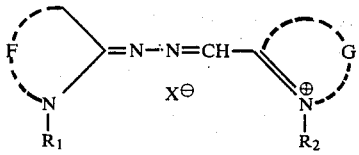

wherein A, together with the group

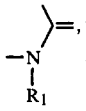

is a group represented by formula (1), (2), (3), or (4)

(1)

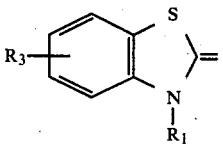

(2)

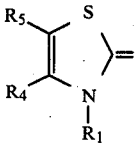

(3)

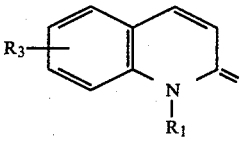

(4)

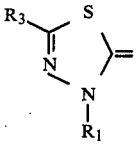

B, together with the group

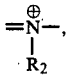

is a group represented by formula (5), (6), (7), (8), (9), or (10)

(5)

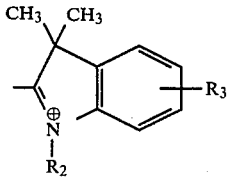

-continued
(6)
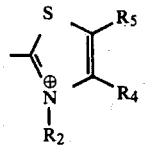
(7)
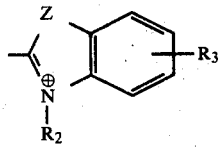
(8)
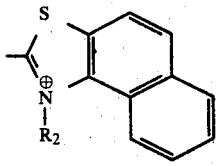
(9)
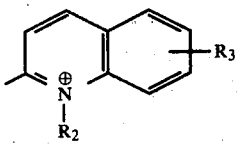
(10)
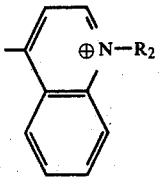
wherein Z is —O—, —Se— or —S—;
Q, together with the group
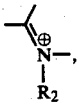
is a group represented by formula (11), (12), (13) or (14)
(11)
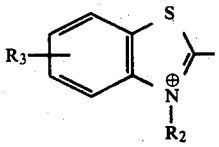
(12)
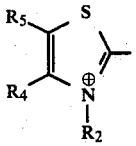
(13)
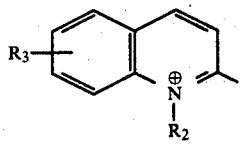
-continued
(14)
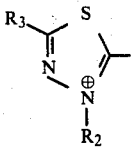
D, together with the group
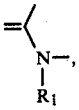
is a group represented by formula (15) or (16)
(15)
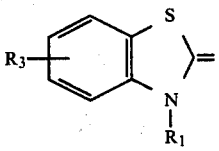
(11)
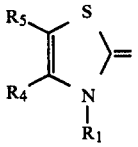
E, together with the group
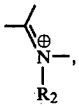
is a group represented by formula (17) or (18)
(17)
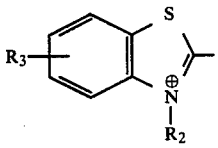
(18)
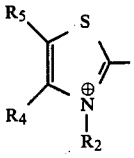
F, together with the group
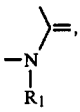
is a group represented by formula (19), (20), (21), (22), or (23)

(19)

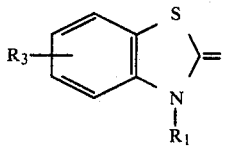

(20)

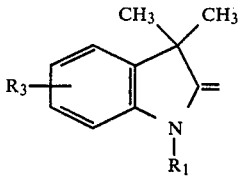

(21)

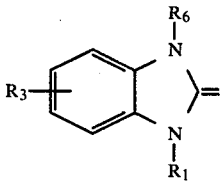

(22)

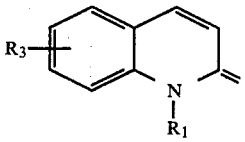

(23)

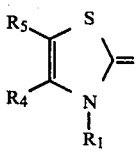

G, together with the group

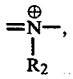

is a group represented by formula (24), (25), (26), or (27)

(24)

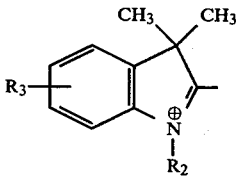

(25)

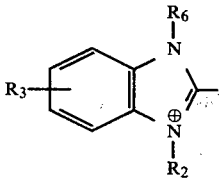

(26)

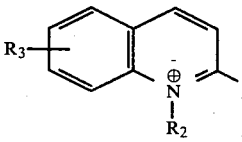

-continued (27)

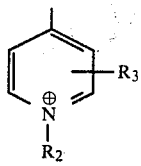

and $R_1$, $R_2$, and $R_6$ are each an alkyl group, and $R_3$, $R_4$, and $R_5$ are each hydrogen, an alkyl group, an alkoxy group, or a substituted alkyl group.

2. A spectral sensitizer as in claim 1, wherein the alkyl group represented by $R_1$, $R_2$, or $R_6$ is an alkyl group containing from 1 to 12 carbon atoms, and the alkyl group represented by $R_3$, $R_4$, or $R_5$ is an alkyl group containing from 1 to 12 carbon atoms, an alkoxy group containing from 1 to 12 carbon atoms, or a substituted alkyl group containing from 1 to 18 carbon atoms.

3. A spectral sensitizer as in claim 1, wherein the substituent is an alkoxyalkyl, an aryloxyalkyl, a hydroxyalkyl, an aralkyl, a cyanoalkyl, or a haloalkyl group.

4. A photoconductive composition as in claim 1, 2, or 3, wherein the organic photoconductive substance is polyvinylcarbazole or its derivative, an aromatic amino derivative, a polyarylalkane derivative, a heterocyclic ring-containing compound, a condensed ring-containing compound, a double bond-containing compound, a condensation product of aldehyde and an aromatic amine, a reaction product of a secondary aromatic amine and an aromatic halide, an aromatic amine-containing condensation product, a vinyl polymer or an organic photoconductive oligomer.

5. A photoconductive composition as in claim 1, 2, or 3, wherein the spectral sensitizer is present in an amount of from 0.005 to 10 parts by weight per about 1 to 80 parts by weight of the organic photoconductive substance.

6. A photoconductive composition as in claim 1, 2, or 3 including a binder selected from the group consisting of a film-forming photoconductive compound and an insulative film-forming compound.

7. A photosensitive member comprising a melt-extruded film of a photoconductive composition comprising an organic photoconductive substance and at least one spectral sensitizer selected from azacyanines represented by formula (I), (II), (III), (IV), or (V)

(I)

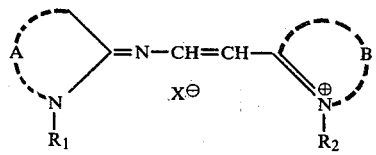

(II)

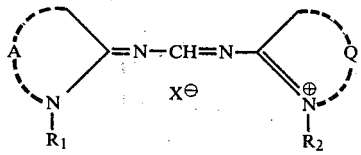

-continued
(III)
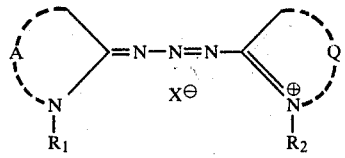
(IV)
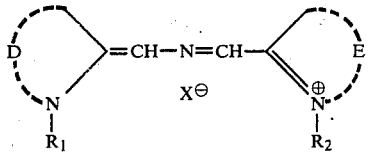
(V)
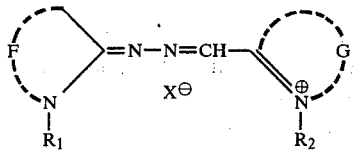
wherein A, together with the group
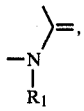
is a group represented by formula (1), (2), (3) or (4)
(1)
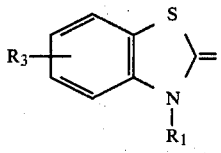
(2)
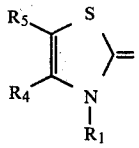
(3)
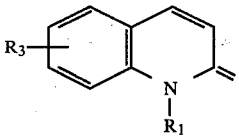
(4)
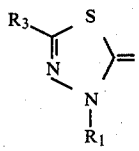
B, together with the group
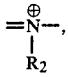
is a group represented by formula (5), (6), (7), (8), (9), or (10)
(5)
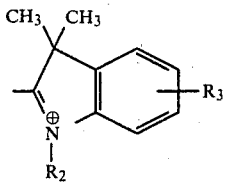
(6)
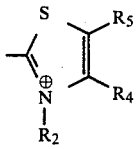
(7)
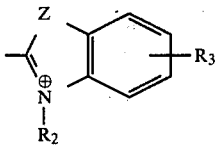
(8)
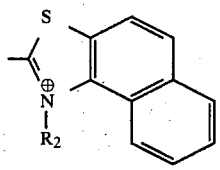
(9)
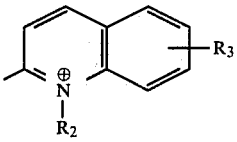
(10)
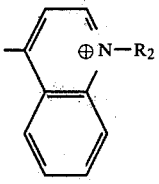
wherein Z is —O—, —Se— or —S—; Q, together with the group
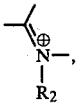
is a group represented by formula (11), (12), (13), or (14)
(11)
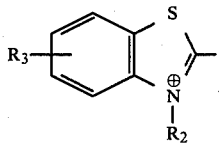

-continued
(12)
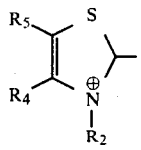
(13)
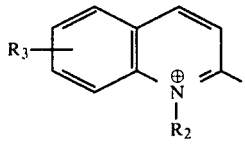
(14)
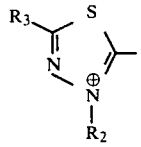
D, together with the group
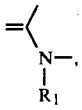
is a group represented by formula (15) or (16)
(15)
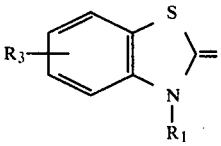
(11)
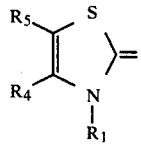
E, together with the group
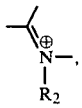
is a group represented by formula (17) or (18)
(17)
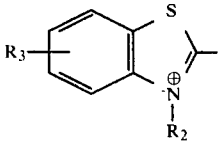
-continued
(18)
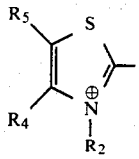
F, together with the group
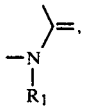
is a group represented by formula (19), (20), (21), (22), or (23)
(19)
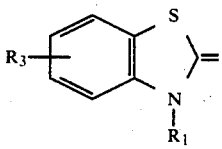
(20)
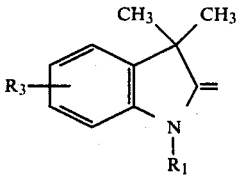
(21)
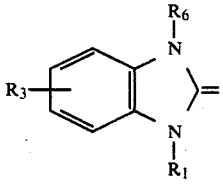
(22)
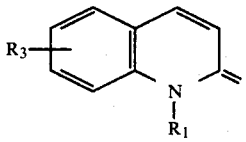
(23)
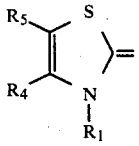
G, together with the group
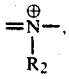
is a group represented by formula (24), (25), (26), or (27)

(24)

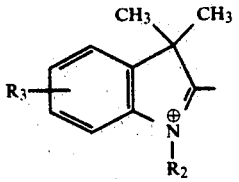

(25)

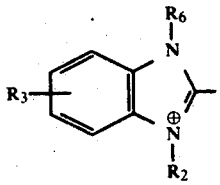

-continued (26)

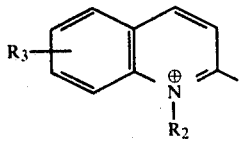

(27)

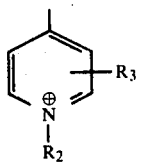

and $R_1$, $R_2$, and $R_6$ are each an alkyl group, and $R_3$, $R_4$, and $R_5$ are each hydrogen, an alkyl group, an alkoxy group, or a substituted alkyl group.

8. A photosensitive member as in claim 7, wherein said member is a self-supporting film of said photoconductive composition.

9. A photosensitive member as in claim 7, wherein the film of the photoconductive composition is coated on an electrically conductive support.

* * * * *